United States Patent [19]

Boda

[11] Patent Number: 4,496,326

[45] Date of Patent: Jan. 29, 1985

[54] SELECTIVELY DISENGAGEABLE, TILLER ACTUATED VANE STEERING SYSTEM

[75] Inventor: James C. Boda, Winneconne, Wis.

[73] Assignee: Brunswick Corporation, Skokie, Ill.

[21] Appl. No.: 451,611

[22] Filed: Dec. 20, 1982

[51] Int. Cl.[3] ..... B63H 21/26

[52] U.S. Cl. ..... 440/62; 440/53; 440/63; 114/144 R

[58] Field of Search ..... 440/62, 63, 51, 53, 440/900, 84–87; 74/471 R, 480 R, 501 R; 114/144 R; 244/82

[56] References Cited

U.S. PATENT DOCUMENTS

| | | | |
|---|---|---|---|
| 2,041,704 | 5/1936 | Gorden et al. | 440/900 |
| 2,577,439 | 12/1951 | Wendt | 244/82 |
| 4,362,515 | 12/1982 | Ginnow | 440/62 |

*Primary Examiner*—Sherman D. Basinger
*Assistant Examiner*—Edwin L. Swinehart
*Attorney, Agent, or Firm*—Andrus, Sceales, Starke & Sawall

[57] ABSTRACT

A steering system for a marine drive having a propulsion unit pivotally mounted on the transom of a watercraft and a tiller. The steering system includes a steering vane rotatably mounted on the propulsion unit for generating hydrodynamic forces to pivot or assist in pivoting the propulsion unit and to counteract propeller torque. A mount interposed between the propulsion unit and the tiller mounts the tiller for movement relative to the propulsion unit. A cable connects the tiller to the steering vane so that movement of the tiller with respect to the propulsion unit rotates the vane. The mount includes mutually engageable elements that can lock the tiller against movement relative to the propulsion unit so that the tiller may be used to directly steer the propulsion unit, if desired. For this purpose, the elements of the mount may be engaged by applying a downward pressure on the tiller.

10 Claims, 5 Drawing Figures

SELECTIVELY DISENGAGEABLE, TILLER ACTUATED VANE STEERING SYSTEM

The present invention relates to a marine drive and more particularly to an improved vane steering system for a marine drive, such as an outboard motor.

An outboard motor is clamped to the transom of a watercraft with the propulsion unit in the water. A tiller or steering arm extends from the outboard motor into the watercraft. The operator steers by pushing or pulling on the tiller to rotate the propulsion unit with respect to the transom mounting bracket about a vertical steering axis. A force must be exerted on the outboard motor by the operator to retain the propulsion unit in the desired steering position against the torque of the propeller, force of the water, and other influences.

While mechanical steering systems utilizing a steering wheel have come into use with marine drives, in a great many cases such drives continue to be steered with the tiller. For example, in remote regions of the world, the simplicity, ruggedness, and economy of tiller steered marine drives make their use widespread. In certain services, such as riverine water transport in these and other regions, the period of use of the marine drive may be measured in days. And, a high degree of steering activity may be required to navigate a serpentine river containing numerous obstacles. Steering the watercraft with the tiller under these conditions, against the steering loads imposed by the water and propeller torque becomes extremely fatiguing to the operator.

It is known to steer a marine drive, such as an outboard motor, by means of a rotatable steering vane mounted on the propulsion unit. The hydrodynamic forces generated upon rotating the vane assist in overcoming the forces on the propulsion unit, thus reducing steering loads. The vane steering may be accomplished by a lost motion mechanism in the steering system in which the lost motion is used to operate the steering vane. In the event the vane steering system cannot provide steering of sufficient magnitude or rapidity, the propulsion unit can be turned directly from the steering system. As examples of steering systems of this type, reference is made to U.S. Pat. No. 2,993,464 to Conover; U.S. Pat. No. 3,943,878 to Kirkwood, et al; and U.S. Pat. No. 4,349,341 to Morgan, et al, assigned to the assignee of the present application.

However, such vane steering systems are generally directed to mechanical steering systems. Further, in such systems, vane steering always precedes direct steering. In applications such as riverine transport in remote regions, it approaches necessity to be able to abruptly disengage the vane steering system and revert to direct steering to avoid suddenly appearing obstacles, and the like.

It is, therefore, the object of the present invention to provide an improved tiller actuated vane steering system in which the steering vane may be quickly and easily disengaged or locked out when necessary or desired.

In the steering system of the present invention a mounting means is interposed between the propulsion unit of the marine drive and the tiller. The mounting means mounts the tiller on the propulsion unit so that the former can move relative to the latter by a limited amount. A cable connects the tiller to the steering vane such that movement of the tiller with respect to the propulsion unit rotates the steering vane to offset the propeller torque. Rotation of the vane also pivots or assists in pivoting the marine drive and steering the watercraft. The mounting means can also lock the tiller against movement relative to the propulsion unit so that the tiller may be used to directly steer the propulsion unit. For this purpose, elements of the mounting means may have locking means that are engaged by applying a downward pressure on the tiller.

The invention will be further explained in the following detailed description of a preferred embodiment, with the aid of the accompanying drawing.

Figure 1:
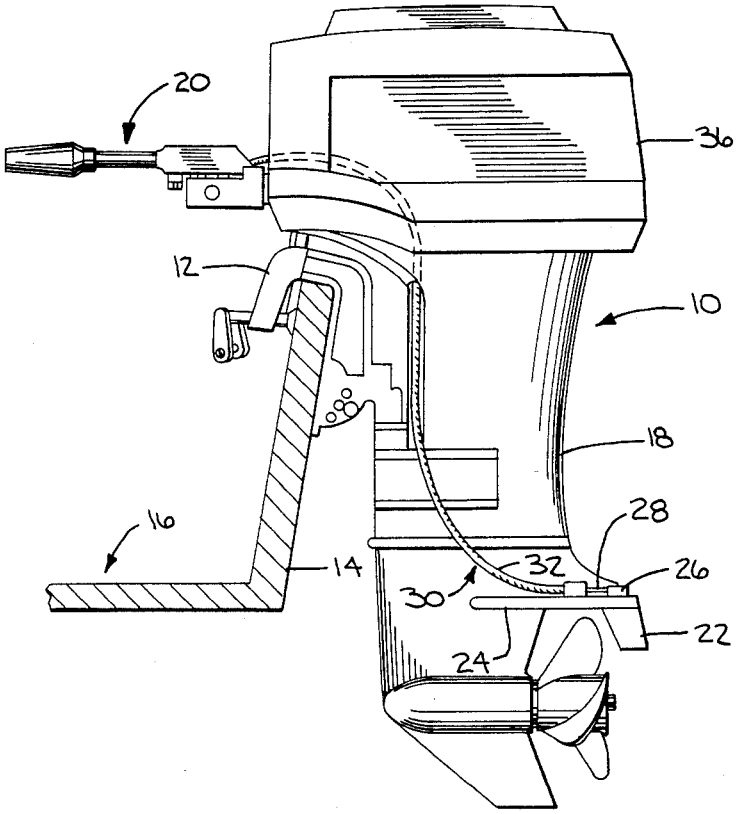
FIG. 1 is a side view of an outboard motor marine drive showing the tiller actuated steering vane system of the present invention.

In FIG. 1, a marine drive, shown as outboard motor 10, has mounting bracket 12 clamped to transom 14 of watercraft 16. Propulsion unit 18 is pivotally mounted on bracket 12 for rotation about a generally vertical steering axis. Outboard motor 10 has tiller 20, the construction of which is hereinafter described in detail.

For use in the vane steering system of the present invention, outboard motor 10 has steering vane 22 mounted on anti-cavitation plate 24. Steering vane 22 has a vane post journalled in anti-cavitation plate 24. The steering post contains a steering bar 26 on the upper end. Core 28 of vane steering cable 30 is connected to steering bar 26. Casing 32 of vane steering cable 30 is clamped to propulsion unit 18 so that movement of the core rotates steering vane 22.

Figure 2:
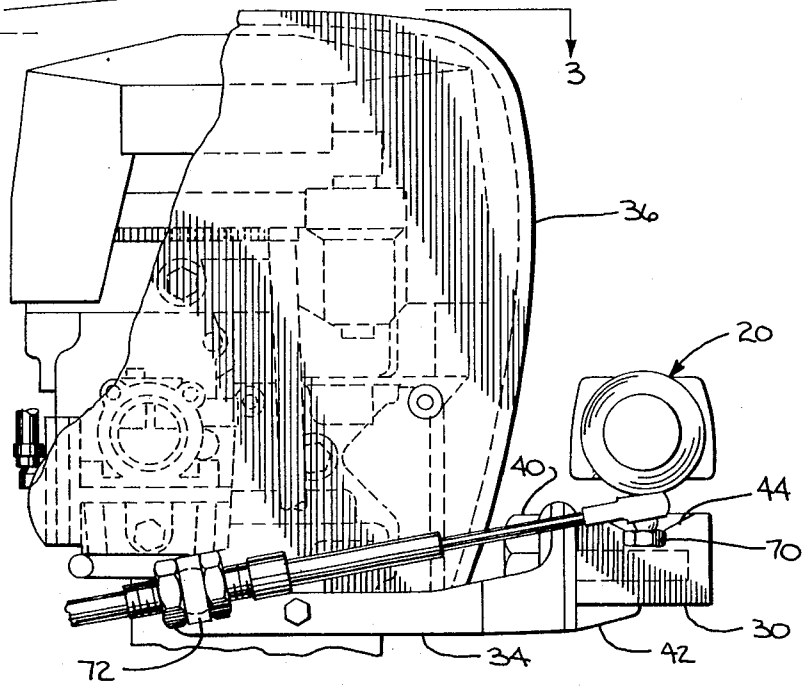
FIG. 2 is a partial front view of the power head of the outboard motor showing the tiller actuated steering vane system of the present invention.

The upper portions of propulsion unit 18 are shown in FIG. 2. Bracket 34 is mounted at the base of power head 36 of propulsion unit 18 and extends forward of the power head.

Figure 4:
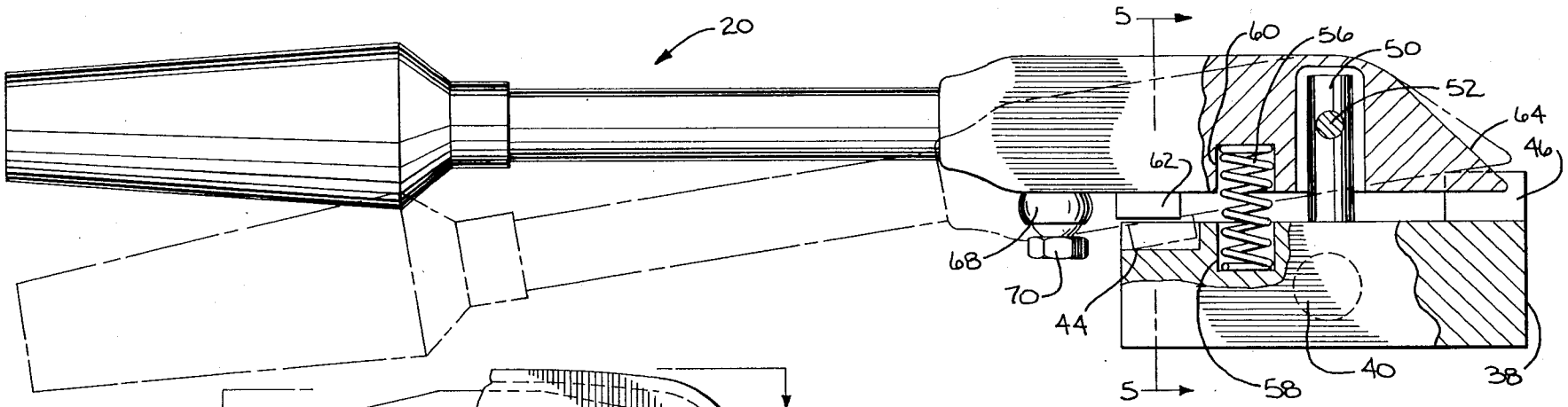
FIG. 4 is a side view of the system showing the tiller in a first operative position in solid lines and in a second operative position in phantom.

In accordance with the present invention, block 38 is mounted on bracket 34 as by bolt 40. Stop 42 positions block 38 so that tiller 20 is in the generally horizontal operating position shown in FIG. 1. Block 38 has V-shaped notch 44 in the forward portion, as shown in FIGS. 4 and 5 and a pair of projections 46 and 48 spaced in a direction parallel to bolt 40 in the rear portion.

Tiller 20 is mounted on block 38. For this purpose, tiller 20 may contain post 50 having transverse pin 52. Pin 52 is inserted in journal 54 at the rear of tiller 20 so that post 50 is retained in tiller 20. Post 50 is rotatably journalled in block 38 and is retained in block 38 by suitable means, not shown. Tiller 20 extends forward and beyond block 38 and can rotate in a horizontal plane with respect to block 38 by the journalling of post 50 in block 38. Tiller 20 can rotate in a vertical plane with respect to block 38 by journalling of pin 52 in journal 54.

Figure 5:
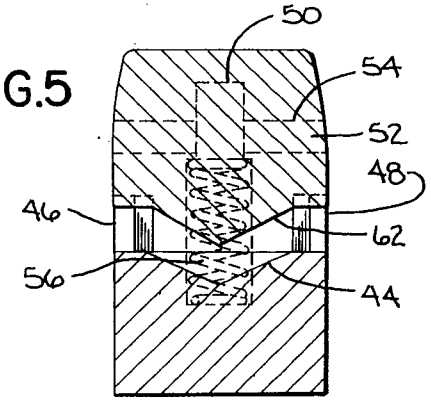
FIG. 5 is a cross sectional view taken along the lines 5—5 of FIG. 4 showing the tiller in the first operative position.

The portion of tiller 20 extending over block 38 is maintained in spaced relation to the block by spring 56 shown in FIG. 5. Spring 56 is inserted in bores 58 and 60 in block 38 and tiller 20, respectively. Also, as shown in FIG. 5, the underside of tiller 20 contains V-shaped projection 62 mateable with V-shaped notch 44 in block 38 but spaced therefrom by the bias of spring 56. Projection 64 of tiller 20 extends to the rear of the tiller between projections 46 annd 48. Projection 64 limits the amount of rotation between tiller 20 and block 38 in the horizontal plane by abutment with projections 46 and 48 on block 38. Tiller 20 includes throttle control handle 66 by which the throttle of power head 36 may be opened and closed through rotation of the control handle.

Figure 3:
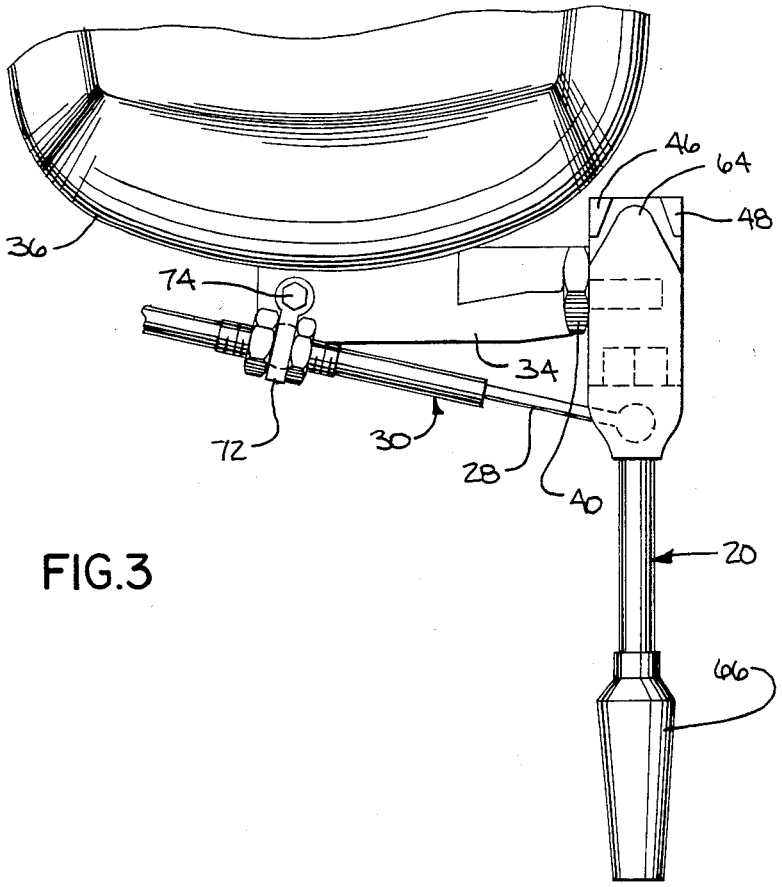
FIG. 3 is a partial top view of the tiller steering system taken along the line 3—3 of FIG. 2.

Core 28 of steering cable 30 is fastened to tiller 20 intermediate post 50 and throttle control handle 66 by knuckle joint 68 and bolt 70. Casing 32 of cable 30 is fastened to bracket 34 on power head 36 by passing it through knuckle 72 fastened by bolt 74. As shown in FIG. 1 and 3, vane steering cable 30 is mounted on the left or port side of propulsion unit 18 adjacent steering vane 22 but passes to the other side of outboard motor 10 at power head 36 to approach tiller 20 from the right or starboard side.

To steer watercraft 16 with steering vane 22, the steering vane is moved in the same direction as it is desired to turn the watercraft and opposite to the necessary turning of outboard motor 10. For example, to steer watercraft 16 to the left, or to port, i.e. to swing the bow in the counterclockwise direction, steering vane 22 must also be rotated in the counterclockwise direction. The counterclockwise rotation of steering vane 22 generates a hydrodynamic force on outboard motor 10 that rotates the motor in the clockwise direction. This turns the bow of the watercraft in the counterclockwise direction.

In the operation of the vane steering system of the present invention to produce the above action, it may be assumed that water is flowing past steering vane 22 at a speed sufficient to generate the necessary hydrodynamic forces. To steer the watercraft to port, tiller 20 is moved to starboard as though outboard motor 10 was being steered in the conventional manner. This pushes core 28 of cable 30 at the power unit end of the cable and extends the end of core 28 coupled to steering bar 26. The extension of this end of core 28 rotates steering vane 22 in the counterclockwise direction. The hydrodynamic forces on steering vane 22 rotate outboard motor 10 clockwise to steer watercraft 16 to port.

As outboard motor 10 turns clockwise, it becomes centered with respect to tiller 20 that has been moved to starboard. This returns vane 22 to the centered position with respect to propulsion unit 18 so that the steering action becomes self-terminating with propulsion unit 18 in the turned position. The force required to steer outboard motor 10 by tiller 20 in the above described manner is considerably lower than in the conventional manner.

To return outboard motor 10 to the straight ahead position with respect to watercraft 16, or to steer watercraft 16 to starboard, the above described operation is reversed.

Vane 22 may also be rotated by the operator to counteract the propeller torque that tends to pivot outboard motor 10 about the steering axis. The hydrodynamic forces of steering vane 22 overcome all or portions of this and other forces or torques acting on the propulsion unit.

Further, the force required to move steering vane 22 is reduced by the mechanical advantage of the long lever arm of tiller 20 as compared to the shorter lever arm formed by the intermediate attachment of core 28 to tiller 20. If desired, the force required to rotate steering vane 22 can also be reduced by counterbalancing steering vane 22: that is, by putting a portion of steering vane 22 ahead of the post to which steering bar 26 is fastened.

As a result of the reduction in steering forces, the effort required to steer watercraft 16 for extended periods, and the attendant fatigue to the operator, is substantially lessened.

Projection 64 limits the amount by which tiller 20 can move with respect to outboard motor 10 through abutment with projections 46 and 48 on the rear of block 38. This limits the amount by which steering vane 22 can rotate with respect to propulsion unit 18. If tiller 20 is moved faster than propulsion unit 18 can respond, projection 64 of tiller 20 moves into abutment with one or the other of projections 46 and 48 on block 38 so that further movement of tiller 20 directly moves propulsion unit 18.

On occasion, it is necessary to disengage or lock out the vane steering system. For example, it may be necessary to abruptly turn watercraft 16 to avoid a suddenly observed obstacle in the water. Or at low watercraft speeds, as when maneuvering in a crowded harbor, there may be insufficient hydrodynamic forces generated by vane 22 to turn outboard motor 10.

In these situations, the end of tiller 20 containing throttle control handle 66 is pressed down against the bias of spring 56. This moves tiller 20 out of the first operative position described above and shown in solid lines in FIG. 4 to the second operative position shown in phantom. Tiller 20 pivots about pin 52 to engage projection 62 in notch 44 of block 38. This couples tiller 20 directly to block 38 so that tiller 20 may be used to steer outboard motor 10 in the conventional manner. To return to the use of vane steering of outboard motor 10, the downward pressure on tiller 20 is released to disengage projection 62 from notch 44.

For storage of outboard motor 10, tiller 20 may be pivoted upwardly about bolt 40 so that tiller 20 lies along the side of power head 36. Cable 30 may be previously disconnected from tiller 20, if desired.

Various modes of carrying out the invention are contemplated as being within the scope of the following claims particularly pointing out and distinctly claiming the subject matter which is regarded as the invention.

I claim:

1. A steering system for a marine drive having a propulsion unit pivotally mounted on a watercraft for moving and steering the watercraft through the water, said marine drive further having a tiller, said steering system comprising:

a steering vane rotatably mounted on the propulsion unit for generating a hydrodynamic torque on the propulsion unit upon rotation tending to pivot the propulsion unit with respect to the watercraft;

mounting means intermediate the propulsion unit and the tiller for mounting the tiller on the propulsion unit, said mounting means being operable to a first condition in which the tiller can move relative to the propulsion unit and to a second condition in which the tiller does not move relative to the propulsion unit; and means coupling the tiller to said steering vane for causing movement of the tiller with respect to the propulsion unit to rotate said steering vane, the tiller being movable in a direction other than said last mentioned movement to operate said mounting means between said conditions.

2. The steering system of claim 1 wherein said mounting means includes a first element coupled to the propulsion unit and a second element coupled to the tiller, said first and second elements mounting the tiller on the propulsion unit and being mutually engageable to place said mounting means in said second condition.

3. The steering system of claim 2 wherein said first and second elements are spaced with respect to each other when said mounting means is in said first condition and movable in abutment with each other to place said mounting means in said second condition.

4. The steering system of claim 3 wherein said mounting means includes bias means maintaining said first and second elements in spaced relation, said bias means being overcome by pressure applied to the tiller to move the elements into abutment.

5. The steering system of claim 3 wherein the propulsion unit is pivotable about a steering axis, wherein the mounting means is so formed as to permit movement of the tiller with respect to the propulsion unit in a plane generally normal to the steering axis to operate the steering vane, and wherein said first and second elements are movable into abutment with each other in a plane parallel to the steering axis.

6. The steering system of claim 1 wherein said mounting means includes means limiting the amount of movement of the tiller with respect to the propulsion unit.

7. The steering system according to claim 1 wherein said coupling means comprises a flexible cable.

8. The steering system of claim 7 wherein the tiller has a pair of ends, one of which is connected to said mounting means and wherein said cable is connected to the tiller intermediate its ends.

9. A steering system for a marine drive having a propulsion unit pivotally mounted on a watercraft for moving and steering the watercraft through the water, said marine drive further having a tiller, said steering system comprising:

a steering vane rotatably mounted on the propulsion unit for generating a hydrodynamic torque on the propulsion unit upon rotation tending to pivot the propulsion unit with respect to the watercraft;

mounting means intermediate the propulsion unit and the tiller for mounting the tiller on the propulsion unit, said mounting means being operable to a first condition in which the tiller can move relative to the propulsion unit and to a second condition in which the tiller does not move relative to the propulsion unit; and means coupling the tiller to said steering vane for causing movement of the tiller with respect to the propulsion unit to rotate said steering vane, wherein said mounting means includes a first element coupled to the propulsion unit and a second element coupled to the tiller, said first and second elements mounting the tiller on the propulsion unit and being mutually engageable to place said mounting means in said second condition, wherein said first and second elements are spaced with respect to each other when said mounting means is in said first condition and movable in abutment with each other to place said mounting means in said second condition, wherein one of said first and second elements has a groove engaging a projection on the other of said first and second elements when said elements are in abutment.

10. A steering system for a marine drive having a propulsion unit pivotally mounted on a watercraft for moving and steering the watercraft through the water, said marine drive further having a tiller, said steering system comprising:

a steering vane rotatably mounted on the propulsion unit for generating a hydrodynamic torque on the propulsion unit upon rotation tending to pivot the propulsion unit with respect to the watercraft;

mounting means intermediate the propulsion unit and the tiller for mounting the tiller on the propulsion unit, said mounting means being operable to a first condition in which the tiller can move relative to the propulsion unit and to a second condition in which the tiller does not move relative to the propulsion unit; and means coupling the tiller to said steering vane for causing movement of the tiller with respect to the propulsion unit to rotate said steering vane, wherein said mounting means includes a first element coupled to the propulsion unit and a second element coupled to the tiller, said first and second elements mounting the tiller on the propulsion unit and being mutually engageable to place said mounting means in said second condition, wherein said first and second elements are spaced with respect to each other when said mounting means is in said first condition and movable in abutment with each other to place said mounting means in said second condition, wherein said second element includes a post journalled in said first element for providing the relative movement of the tiller with respect to the propulsion unit, and wherein said post has a transverse pin in which said tiller is journalled for moving said elements into abutment.

* * * * *